US011666081B2

(12) United States Patent
Liu

(10) Patent No.: US 11,666,081 B2
(45) Date of Patent: Jun. 6, 2023

(54) TOBACCO ROASTER

(71) Applicant: Shenzhen Eigate Technology Co., Ltd., Shenzhen (CN)

(72) Inventor: Tuanfang Liu, Shenzhen (CN)

(73) Assignee: ASPIRE NORTH AMERICA LLC

( * ) Notice: Subject to any disclaimer, the term of this patent is extended or adjusted under 35 U.S.C. 154(b) by 153 days.

(21) Appl. No.: 17/131,607

(22) Filed: Dec. 22, 2020

(65) Prior Publication Data

US 2022/0061375 A1 Mar. 3, 2022

(30) Foreign Application Priority Data

Aug. 25, 2020 (CN) ..... 202010866622.8
Aug. 25, 2020 (CN) ..... 202021798901.7

(51) Int. Cl.
*A24B 13/00* (2006.01)

(52) U.S. Cl.
CPC ..... *A24B 13/00* (2013.01)

(58) Field of Classification Search
CPC ..... A24F 40/20; A24F 40/465; A24F 40/40; A24F 1/30; A24F 40/57; A24F 40/51
USPC ..... 131/229
See application file for complete search history.

(56) References Cited

U.S. PATENT DOCUMENTS

| | | | | |
|---|---|---|---|---|
| 2019/0124988 | A1* | 5/2019 | Hu | H05B 6/36 |
| 2020/0260778 | A1* | 8/2020 | Miller | A24F 3/00 |
| 2021/0274836 | A1* | 9/2021 | Liu | H05B 6/108 |
| 2021/0360973 | A1* | 11/2021 | Liu | A24F 1/30 |

FOREIGN PATENT DOCUMENTS

| | | | | |
|---|---|---|---|---|
| CN | 1094927621 | * | 3/2019 | A24F 40/42 |
| CN | 110169596 | * | 8/2019 | |
| CN | 111165875 | * | 5/2020 | A24F 1/30 |
| CN | 111406980 | * | 7/2020 | A24F 1/30 |
| WO | WO-2017144028 A1 | * | 8/2017 | A24F 40/42 |
| WO | WO-2018107497 A1 | * | 6/2018 | |
| WO | WO-2019178834 A1 | * | 9/2019 | |

OTHER PUBLICATIONS

English Language machine translation of WO-2017144028-A1. (Year: 2017).*
English Language machine translation of WO-2018107497-A1. (Year: 2018).*
English Language machine translation of CN1094927621. (Year: 2019).*
English Language machine translation of CN110169596. (Year: 2019).*
English Language machine translation of WO-2019178834-A1 (Year: 2019).*

* cited by examiner

*Primary Examiner* — Galen H Hauth
*Assistant Examiner* — Dionne W. Mayes
(74) *Attorney, Agent, or Firm* — Matthias Scholl P.C.; Matthias Scholl

(57) ABSTRACT

A tobacco roaster includes a high frequency heating module and a pushing assembly. The high frequency heating module includes a metal cup and a magnetic induction coil. The metal cup is disposed in the magnetic induction coil. When alternating current flows through the magnetic induction coil, an eddy current effect is formed in the metal cup and the metal cup is heated. The pushing assembly includes a push rod disposed below the metal cup. The push rod is movable to push the metal cup out of the tobacco roaster.

6 Claims, 3 Drawing Sheets

TOBACCO ROASTER

CROSS-REFERENCE TO RELATED APPLICATIONS

Pursuant to 35 U.S.C. § 119 and the Paris Convention Treaty, this application claims foreign priority to Chinese Patent Application No. 202010866622.8 filed on Aug. 25, 2020, and to Chinese Patent Application No. 202021798901.7 filed on Aug. 25, 2020. The contents of all of the aforementioned applications, including any intervening amendments thereto, are incorporated herein by reference. Inquiries from the public to applicants or assignees concerning this document or the related applications should be directed to: Matthias Scholl P. C., Attn.: Dr. Matthias Scholl Esq., 245 First Street, 18th Floor, Cambridge, Mass. 02142.

BACKGROUND

The disclosure relates to a tobacco roaster.

Conventionally, a tobacco roaster comprises a fixedly disposed metal cup for accommodating a tobacco material. The tobacco material directly contacts the metal cup and is heated in the metal cup. Thus, the metal cup is easily stained and cannot be taken out of the tobacco roaster for cleaning.

SUMMARY

The disclosure provides a tobacco roaster, comprising a high frequency heating module and a pushing assembly; the high frequency heating module comprises a metal cup and a magnetic induction coil; the metal cup is disposed in the magnetic induction coil; when an alternating current flows through the magnetic induction coil, an eddy current effect is formed in the metal cup and the metal cup is heated; the pushing assembly comprises a push rod disposed below the metal cup; the push rod is movable to push the metal cup out of the tobacco roaster.

In a class of this embodiment, the pushing assembly further comprises a fixed rod; the push rod is disposed around the fixed rod and is movable up and down with respect to the fixed rod.

In a class of this embodiment, the pushing assembly further comprises a press button; the push rod comprises a lateral beam; one end of the lateral beam extends out of the tobacco roaster; the press button is disposed on the one end of the lateral beam; the press button controls the push rod to move up and down.

In a class of this embodiment, the high frequency heating module further comprises a glass cup disposed in the metal cup for accommodating a tobacco material.

In a class of this embodiment, the high frequency heating module further comprises a glass cover disposed on an opening of the metal cup; and the glass cover comprises a top surface comprising a plurality of through holes for air circulation.

In a class of this embodiment, the high frequency heating module further comprises an upper thermal insulation gasket, a sleeve and a lower thermal insulation gasket; the sleeve is disposed in the magnetic induction coil to prevent the deformation of the magnetic induction coil; the metal cup is disposed in the sleeve; and the upper thermal insulation gasket and the lower thermal insulation gasket are disposed on two ends of the magnetic induction coil respectively for thermal insulation.

The following advantages are associated with the tobacco roaster of the disclosure:

1. The tobacco roaster comprises a pushing assembly which is movable to push the metal cup and glass cup out of the tobacco roaster for replacement and cleaning.

2. The tobacco roaster comprises a glass cup disposed in the metal cup for accommodating the tobacco material. The tobacco material does not directly contact the metal cup. The design is environmentally friendly.

3. The tobacco roaster comprises a glass cover comprising a plurality of through holes which can filter smoke and remove granulates, thus preventing the granulates from being inhaled.

DETAILED DESCRIPTION

To further illustrate, embodiments detailing a tobacco roaster are described below. It should be noted that the following embodiments are intended to describe and not to limit the disclosure.

Principle of high frequency heating: when an alternating current is introduced to a magnetic induction coil, an alternating magnetic field will be generated. When a metal conductor is placed in the alternating magnetic field, an eddy current is produced. The eddy current makes the metal conductor heated.

Figure 1:
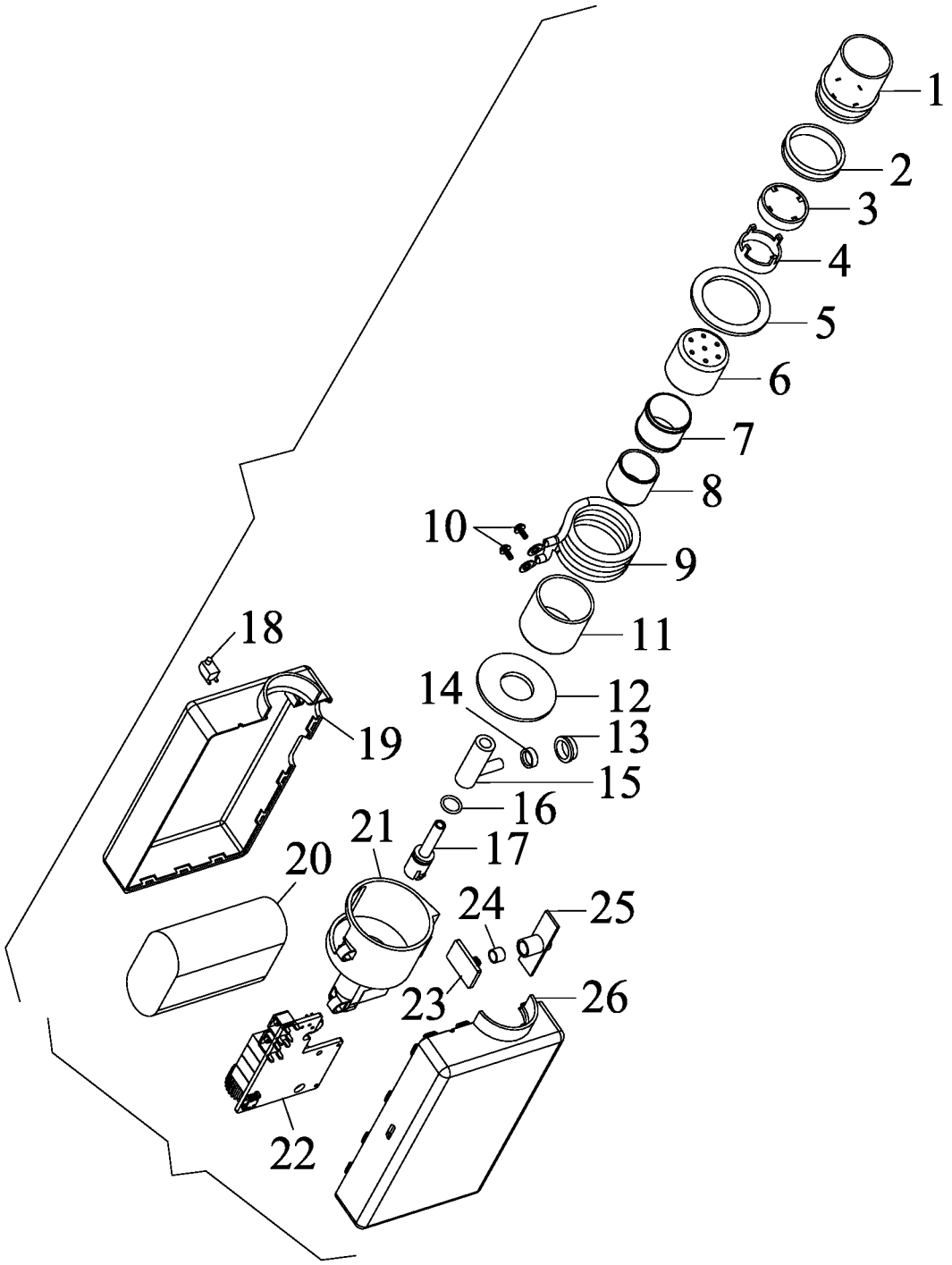
FIG. 1 is an exploded view of a tobacco roaster in accordance with one embodiment of the disclosure.
Figure 2:
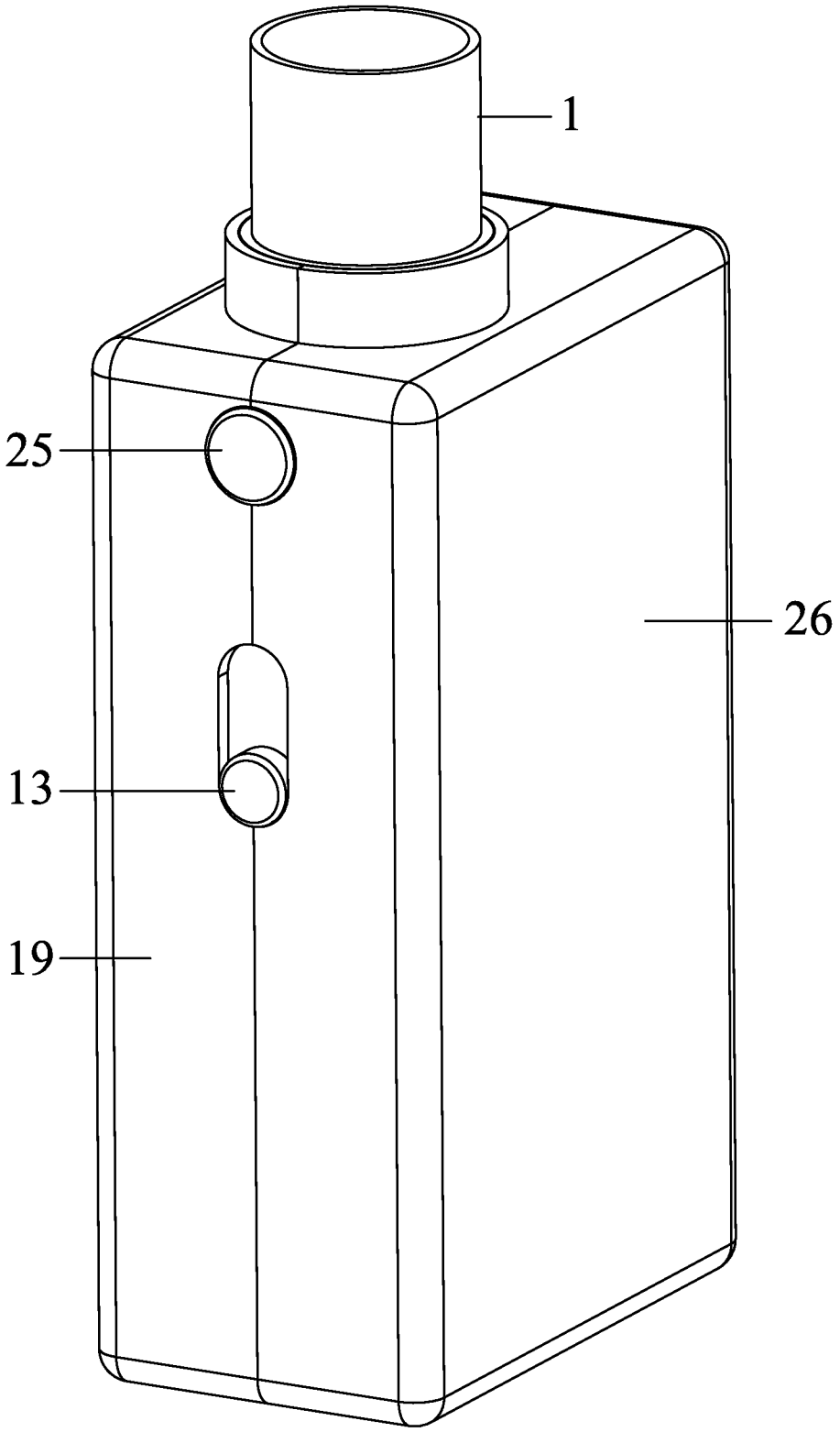
FIG. 2 is a schematic diagram of a tobacco roaster in accordance with one embodiment of the disclosure.
Figure 3:
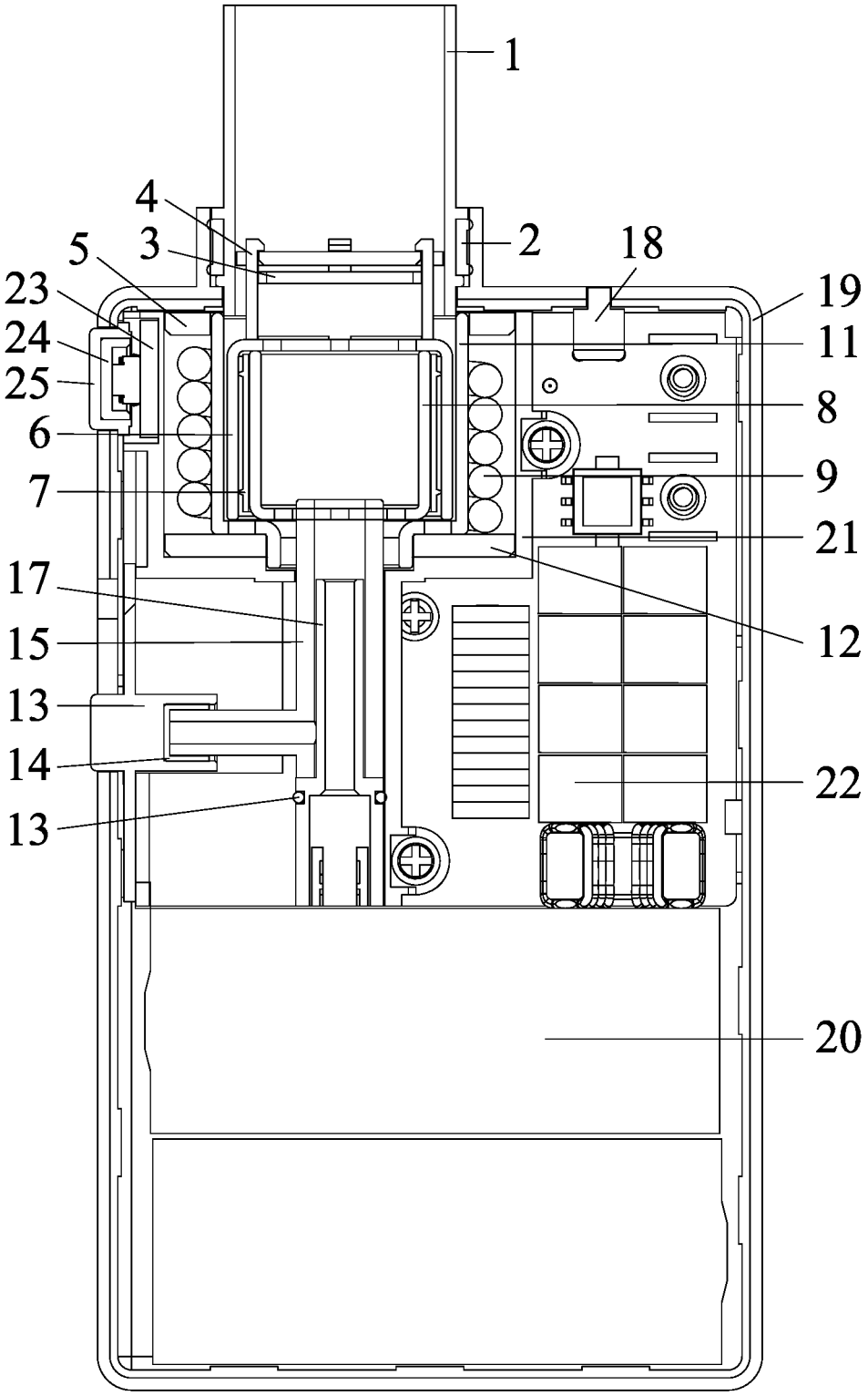
FIG. 3 is a sectional view of a tobacco roaster in accordance with one embodiment of the disclosure.

As shown in FIGS. 1-3, a first embodiment of the disclosure provides a tobacco roaster comprises a mouthpiece 1, a fixed ring 2, a silicone thermal insulator 3, a thermal insulation pipe 4, an upper thermal insulation gasket 5, a glass cover 6, a metal cup 7, a glass cup 8, a magnetic induction coil 9, a screw 10, a sleeve 11, a lower thermal insulation gasket 12, a press button 13, a silicone gasket 14, a push rod 15, a seal ring 16, a fixed rod 17, a light guide 18, a lower cover 19, a battery 20, a base 21, a control panel 22, a button board 23, a button sleeve 24, a power button 25, and an upper cover 26. The glass cup 8 is fixed in the metal cup 7. The sleeve 11 is disposed in the magnetic induction coil 9 to prevent the deformation of the magnetic induction coil 9. The metal cup 7 is disposed in the sleeve 11. The glass cover 6 is disposed on the opening of the metal cup 7. The glass cover 6 comprises a top surface comprising a plurality of through holes for air circulation. When tobacco is placed in the glass tube 8, the plurality of through holes filters the granulates produced by the heated tobacco thus preventing the granulates from being inhaled. The glass cover also prevents the tobacco from pouring out of the glass cup 8 when the tobacco roaster is placed horizontally or upside down. The upper thermal insulation gasket 5 and the lower thermal insulation gasket 12 are disposed on two ends of the magnetic induction coil 9 respectively for thermal insulation. The magnetic induction coil 9 is fixed in the base 21. The input end of the magnetic induction coil 9 is fixed on the output end of the control panel 22 via the screw 10. The input end of the control panel 22 is soldered on the positive and negative terminals of the battery 20. The button board 23 is soldered on the control panel. The light guide 18 is disposed on the LED lamp of the control panel 22 to guide the light and display the power state. The push rod 15 is disposed around the fixed rod 17 and is movable up and down with respect to the fixed rod 17. The seal ring 16 is fixed on the fixe rod 17. The fixed rod 17 runs through the bottom end of the base 21. The base 21, the control panel 22, and the battery 20 are fixed in the lower cover 19. The push rod 15 comprises a lateral beam. The silicone gasket 14 is disposed in the press button 13. One end of the lateral beam extends out of the lower cover 19. The silicone gasket 14 and the press button 13 are disposed on the one end of the lateral beam. Sliding the press button 13 with respect to the lower cover 19 drives the push rod 15 to move up and down and to push out the metal cup 7, the glass cover 6, and the glass cup 8. The button sleeve 24 is disposed in the power button 25. The power button 25 is disposed on the button board 23. The power button 25 is disposed outside the lower cover 19 so as to press the power button 25 to switch on/off the tobacco roaster. The upper cover 26 is disposed on the lower cover 19. The fixed ring 2 is disposed around the mouthpiece 1. The silicone thermal insulator 3 is disposed on the thermal insulation pipe 4. The thermal insulation pipe 4 is disposed in the mouthpiece 1. The mouthpiece 1, the fixed ring 2, the silicone thermal insulator 3, and the thermal insulation pipe 4 constitute a mouthpiece assembly. When the upper cover 26 and the lower cover 19 are combined with each other, a cylindrical passage is formed, and the mouthpiece assembly is fixed in the cylindrical passage for air circulation. When the mouthpiece assembly is taken out of the cylindrical passage, the metal cup 7, the glass cover 6 and the glass cup 8 can be pushed out of the upper cover and the lower cover.

In the first embodiment, the tobacco roaster is mainly used for heating tobacco leaves, also for heating tobacco paste, tobacco tar, and so on. In addition, the tobacco roaster cannot be placed upside down, or the tobacco paste and/or the tobacco tar will leak out of the glass cover 6, the metal cup 7, and the glass cup 8.

In a second embodiment, the fixed rod 17 is omitted, and the bottom end of the base comprises a tube structure. One end of the push rod is disposed in the tube structure. The push rod is movable in the tube structure to push out the metal cup for replacement. The bottom end of the base limits the lowest position of the metal cup.

In a third embodiment, the push rod is disposed in the fixed rod. The side wall of the fixed rod comprises a slot and the lateral beam of the push rod is movable in the slot, thus driving the push rod to move.

In a fourth embodiment, the metal cup 7 is replaced by a glass cup comprising an inlaid metal. In this way, the glass cup 8 in the first embodiment can be omitted.

It will be obvious to those skilled in the art that changes and modifications may be made, and therefore, the aim in the appended claims is to cover all such changes and modifications.

What is claimed is:

1. A tobacco roaster, comprising a high frequency heating module and a pushing assembly; wherein:

the high frequency heating module comprises a metal cup, a glass cup, a magnetic induction coil, and a glass cover;

the metal cup is disposed in the magnetic induction coil; when an alternating current flows through the magnetic induction coil, an eddy current effect is formed in the metal cup and the metal cup is heated;

the glass cup is disposed in the metal cup, the glass cup accommodating a tobacco material and the tobacco material does not directly contact the metal cup;

the glass cover is disposed on an opening of the metal cup; and the glass cover comprises a top surface comprising a plurality of through holes for air circulation;

and the pushing assembly comprises a push rod disposed below the metal cup; the push rod is movable to push the metal cup out of the tobacco roaster.

2. The tobacco roaster of claim 1, wherein the high frequency heating module further comprises an upper thermal insulation gasket, a sleeve and a lower thermal insulation gasket; the sleeve is disposed in the magnetic induction coil to prevent deformation of the magnetic induction coil; the metal cup is disposed in the sleeve; and the upper thermal insulation gasket and the lower thermal insulation gasket are disposed on two ends of the magnetic induction coil respectively for thermal insulation.

3. The tobacco roaster of claim 1, wherein the pushing assembly further comprises a fixed rod; the push rod is disposed around the fixed rod and is movable up and down with respect to the fixed rod.

4. The tobacco roaster of claim 3, wherein the high frequency heating module further comprises an upper thermal insulation gasket, a sleeve and a lower thermal insulation gasket; the sleeve is disposed in the magnetic induction coil to prevent deformation of the magnetic induction coil; the metal cup is disposed in the sleeve; and the upper thermal insulation gasket and the lower thermal insulation gasket are disposed on two ends of the magnetic induction coil respectively for thermal insulation.

5. The tobacco roaster of claim 3, wherein the pushing assembly further comprises a press button; the push rod comprises a lateral beam; one end of the lateral beam extends out of the tobacco roaster; the press button is disposed on the one end of the lateral beam; the press button controls the push rod to move up and down.

6. The tobacco roaster of claim 5, wherein the high frequency heating module further comprises an upper thermal insulation gasket, a sleeve and a lower thermal insulation gasket; the sleeve is disposed in the magnetic induction coil to prevent deformation of the magnetic induction coil; the metal cup is disposed in the sleeve; and the upper thermal insulation gasket and the lower thermal insulation gasket are disposed on two ends of the magnetic induction coil respectively for thermal insulation.

* * * * *